US007210279B1

(12) United States Patent
Ahmed et al.

(10) Patent No.: US 7,210,279 B1
(45) Date of Patent: May 1, 2007

(54) DEVICE FOR WRAPPING A NAPKIN ABOUT SILVERWARE AND ASSOCIATED METHOD

(76) Inventors: Ibrahim A. Ahmed, 2325 NW. 33rd St., Oklahoma City, OK (US) 73112; Ammar Abueisheh, 10213 Jetty Ct., Oklahoma City, OK (US) 73159

( * ) Notice: Subject to any disclaimer, the term of this patent is extended or adjusted under 35 U.S.C. 154(b) by 0 days.

(21) Appl. No.: 11/301,782

(22) Filed: Dec. 14, 2005

(51) Int. Cl.
*B65B 11/04* (2006.01)
*B65B 35/54* (2006.01)

(52) U.S. Cl. ..... 53/155; 53/215; 53/216; 53/389.2

(58) Field of Classification Search ..... 53/215, 53/216
See application file for complete search history.

(56) References Cited

U.S. PATENT DOCUMENTS 1,108,027 A * 8/1914 Thorschmidt ..... 53/215
1,417,956 A * 5/1922 Varga ..... 156/456
3,659,394 A 5/1972 Hartleib et al.
5,115,620 A * 5/1992 Takamura ..... 53/64
5,406,770 A 4/1995 Fikacek
5,469,688 A 11/1995 Dunbar et al.
D396,866 S 8/1998 Carl
6,023,908 A 2/2000 Vetsch
6,023,913 A 2/2000 Gray et al.
6,202,387 B1 * 3/2001 Brown et al. ..... 53/419
6,615,566 B2 * 9/2003 Heisey ..... 53/466
7,076,932 B2 * 7/2006 Rubin ..... 53/461

* cited by examiner

*Primary Examiner*—John Sipos

(57) ABSTRACT

A device includes isolated hoppers defining independent passageways converging downwardly towards a central and unitary area. A conveyor belt assembly is disposed subjacent to the hoppers, traverses the passageways, and travels along a linear path passing through the unitary area. A mechanism is included for depositing a napkin onto the conveyor belt. The napkin depositing mechanism is connected to the conveyor belt assembly and is spaced adjacent to one end portion thereof. A mechanism is included for simultaneously folding the napkin and horizontally stacking the eating utensils such that the napkin becomes folded about the eating utensils before being ejected from the simultaneous folding mechanism. A receiving conveyor belt assembly is disposed beneath the simultaneous folding mechanism for transporting the combined napkin and eating utensils. A storage bin is laid adjacent to the receiving conveyor belt and houses the combined napkin and eating utensils for transit.

18 Claims, 6 Drawing Sheets

DEVICE FOR WRAPPING A NAPKIN ABOUT SILVERWARE AND ASSOCIATED METHOD

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to wrapping devices and, more particularly, to a device for wrapping a napkin about silverware and associated method.

2. Prior Art

Within a large segment of the food service industry, food service providers serve millions of customers reusing a small inventory of silverware, also referred to as eating utensils, which are washed after each use. Because individually handling eating utensils to set places at tables is time-consuming, a significant number of food service providers supply eating utensils in bundles which are prepared well in advance of use by manually wrapping the necessary utensils in napkins.

While this procedure permits more rapid dispensing of utensils when needed, and facilitates the rapid resetting of tables for use, such preparation remains labor intensive. For high volume restaurants and chains, the labor costs may be in the tens of thousands of dollars annually per restaurant. If deferred, such costs could be better spent on maintaining the restaurant facility or increasing the employees' pay, which in turn can increase employee morale.

There is a prior art example of an apparatus for automatically wrapping a napkin about silverware. This apparatus, however, is limited in that it does not automatically place a napkin in a condition for accepting silverware placed thereon nor does it automatically place the silverware upon the napkin. Instead, these steps must be manually performed before the wrapping operation is effected. It would be desirable to provide a napkin-wrapping apparatus which automatically places a napkin in position for accepting silverware placed thereon, as well as automatically wrapping the napkin around the silverware.

Accordingly, a need remains for a device for wrapping a napkin about silverware and its associated method in order to overcome the above-noted shortcomings. The present invention satisfies such a need by providing a utensil wrapping device that is easy and convenient to use, results in energy-, time- and cost-savings, is durable and practical in design, and improves sanitary conditions. Such a device serves as a viable and safer alternative to the traditional method of manually rolling eating utensils in a napkin. The device advantageously eliminates the need for employees to wrap the eating utensils, thus allowing them to tend to customers and other important tasks. In addition, the device keeps the eating utensils clean and sanitary, which reduces the spread of infectious diseases, as well as painful cuts to the hands from sharp knives.

BRIEF SUMMARY OF THE INVENTION

In view of the foregoing background, it is therefore an object of the present invention to provide a device for wrapping a napkin about silverware and associated method. These and other objects, features, and advantages of the invention are provided by a power operated device for automatically folding napkins and the like about eating utensils.

The device includes a plurality of isolated hoppers defining a plurality of independent passageways converging downwardly towards a central and unitary area. Each hopper preferably includes a rotatable dispenser directly connected thereto and seated approximately midway down the passageway. Such a dispenser is simultaneously articulated for discharging a single type of the eating utensil downwardly towards the unitary area.

A conveyor belt assembly is horizontally disposed subjacent to the hoppers and traverses the passageways. Such a conveyor belt assembly travels along a linear path passing through the unitary area. The conveyor belt assembly may include a plurality of pulleys horizontally aligned and maintained at a static spatial relationship. A unitary belt is operably engaged about the pulleys wherein the unitary belt includes top and bottom sections vertically registered parallel to a horizontal plane.

A mechanism is included for selectively depositing a single napkin onto the conveyor belt during operating conditions. Such a napkin depositing mechanism is directly connected to the conveyor belt assembly and is spaced adjacent to one end portion thereof. The napkin depositing mechanism preferably includes a vertically registered pulley assembly traversing a horizontal path defined by the conveyor belt assembly. A first drive motor is operably coupled to the pulley assembly. Such a first drive motor includes a drive shaft directly mated to the pulley assembly and is selectively operable during operating conditions. A platform is directly connected to the pulley assembly and maintains a static relationship therewith such that the platform effectively moves vertically and in sync with the pulley assembly. A second drive motor includes a drive shaft directly coupled to the conveyor belt assembly.

A vacuum head is operably connected directly to the conveyor belt assembly and intercalated between the top and bottom sections of the unitary belt. Such a vacuum head maintains a static relationship therewith so that the vacuum head horizontally travels in sync with the conveyor belt assembly. The vacuum head is situated above a top napkin of the napkin stack and effectively transfers the top napkin across the conveyor belt assembly where the top napkin is deposited at the unitary area before the eating utensils are released from the hoppers. A motor is in fluid communication with the vacuum head for conveniently and effectively extracting a predetermined volume of air away therefrom during operating conditions.

A mechanism is included for simultaneously folding the napkin and horizontally registering the eating utensils in a stacked relationship such that the napkin conveniently and effectively becomes folded about the eating utensils before being ejected from the simultaneous folding mechanism. Such a simultaneous folding mechanism preferably includes a central rod transversely oriented to the conveyor belt assembly and situated therebelow. A cylindrical drum is journaled about the rod and includes an arm monolithically formed with an outer edge thereof. A stationary rail has an arcuate shape outwardly spaced from the drum. A dynamic rail has an arcuate shape outwardly spaced from the drum and oppositely aligned with the stationary rail. Such a dynamic rail is pivotally connected to a support surface subjacent to the conveyor belt assembly. A drive motor includes an actuator arm selectively adaptable between extended and retracted positions. Such an actuator arm is directly attached to a bottom edge of the dynamic rails and thereby causes the dynamic rail to pivot about a top edge thereof when the actuator arm is biased between extended and retracted positions.

A receiving conveyor belt assembly is disposed beneath the simultaneous folding mechanism for advantageously transporting the combined napkin and eating utensils to a remote location. A storage bin is laid adjacent to the receiving conveyor belt and effectively houses the combined napkin and eating utensils for transit.

The device may further include a power operated motor and a central conduit that has axially opposed end portions directly abutted against the motor and extending vertically upward therefrom. A rotary fan is electrically mated to the power operated motor and effectively generates an air flow upwardly about the conduit. A thermo-electric heating element is seated upstream of the fan. The air flow has a first ambient temperature downstream of the heating element and has a second ambient temperature after passing upwardly through the heating element for advantageously and conveniently drying the eating utensils prior to being discharged onto the napkin during operating conditions.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
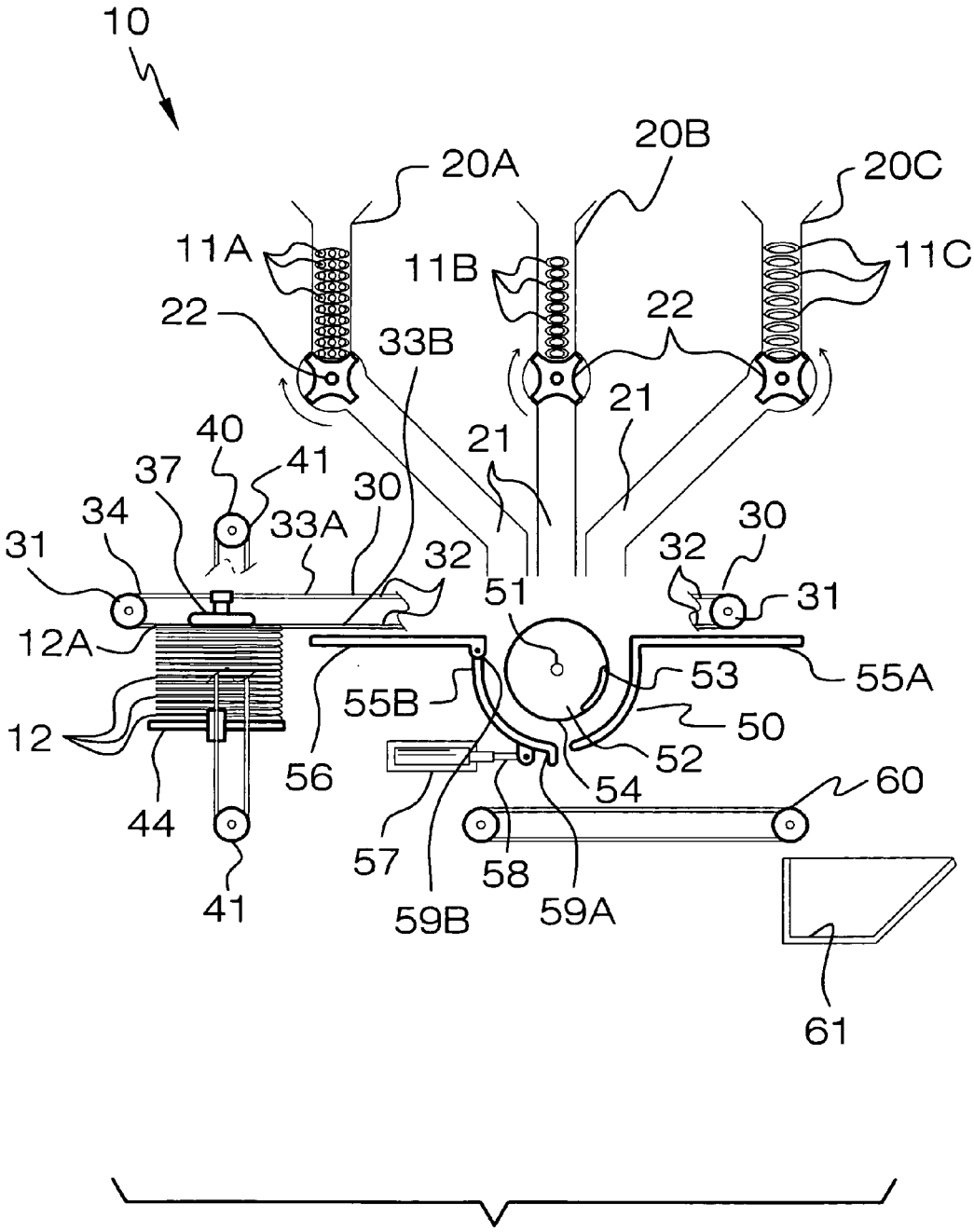
FIG. 1 is a side-elevational view showing a device for wrapping a napkin about silverware and its associated method, in accordance with the present invention.
Figure 2:
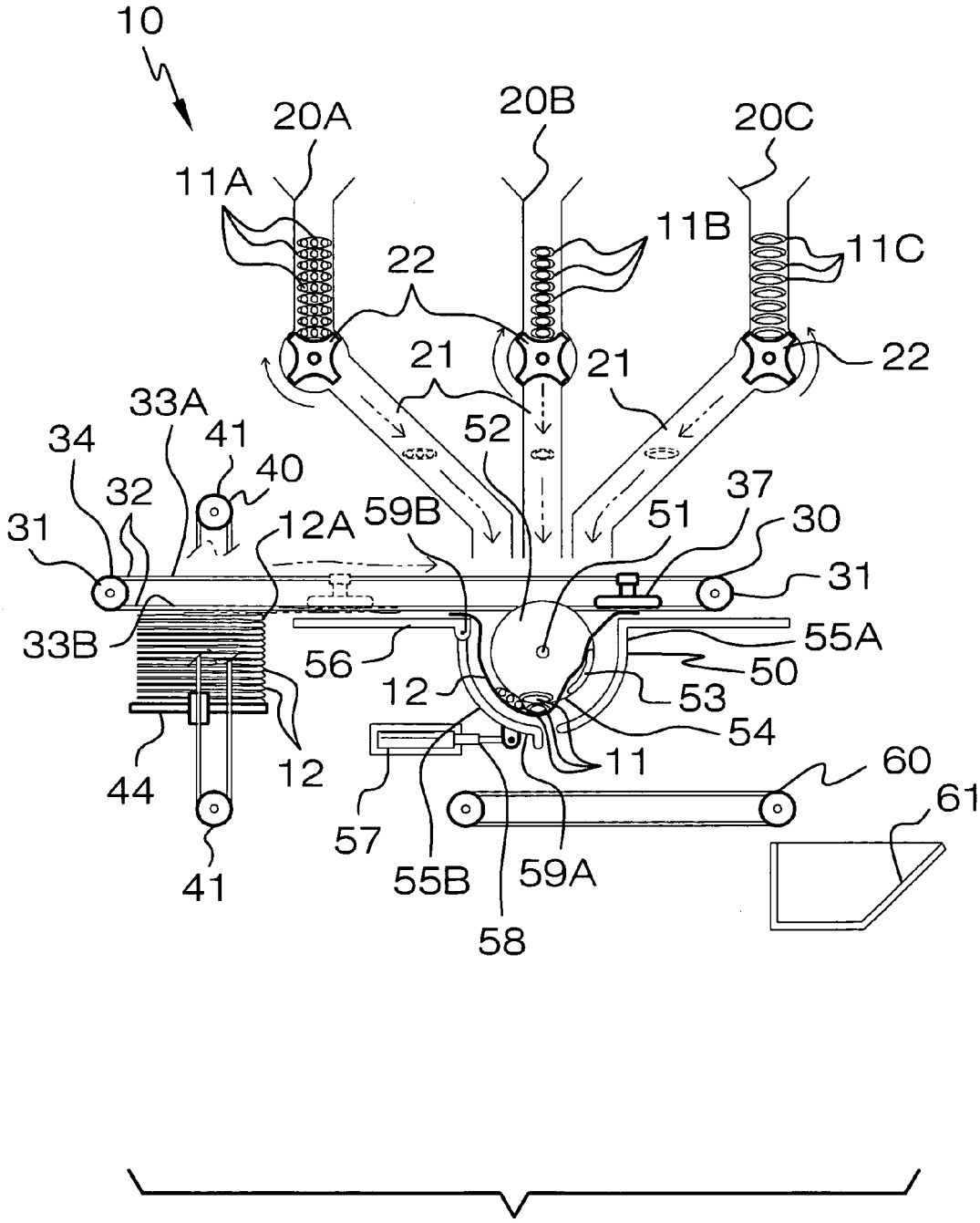
FIG. 2 is a side-elevational view of the device shown in FIG. 1, showing the device during operating conditions.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The device of this invention is referred to generally in FIGS. 1–7 by the reference numeral 10 and is intended to provide a device for wrapping a napkin about silverware and its associated method. It should be understood that the device 10 may be used to wrap napkins about many different types of implements and should not be limited in use to only wrapping napkins about eating utensils.

Referring initially to FIGS. 1 through 4, the device 10 includes a plurality of isolated hoppers 20 defining a plurality of independent passageways 21 converging downwardly towards a central and unitary area. Each hopper 20 includes a rotatable dispenser 22 directly connected thereto, without the use of intervening elements, and seated approximately midway down the passageway 21. Such a dispenser 22 is simultaneously articulated for discharging a single type of the eating utensil 11 downwardly towards the unitary area. A first hopper 20A dispenses forks 11A, a second hopper 20B dispenses knives 11B and a third hopper 20C dispenses spoons 11C. Of course, the hoppers 20 may dispense alternate eating utensils 11 other than those mentioned herein above or additional hoppers 20 may be included for dispensing additional eating utensils 11, as is obvious to a person of ordinary skill in the art.

Referring to FIGS. 1 through 6, a conveyor belt assembly 30 is horizontally disposed subjacent to the hoppers 20 and traverses the passageways 21. Such a conveyor belt assembly 30 travels along a linear path passing through the unitary area. The conveyor belt assembly 30 includes a plurality of pulleys 31 horizontally aligned and maintained at a static spatial relationship. A unitary belt 32 is operably engaged about the pulleys 31 wherein the unitary belt 32 includes top 33A and bottom 33B sections vertically registered parallel to a horizontal plane.

Still referring to FIGS. 1 through 6, a mechanism 40 is included for selectively depositing a single napkin 12 onto the conveyor belt 30 during operating conditions. Such a napkin depositing mechanism 40 is directly connected, without the use of intervening elements, to the conveyor belt assembly 30 and is spaced adjacent to one end portion 34 thereof. The napkin depositing mechanism 40 includes a vertically registered pulley assembly 41 traversing a horizontal path defined by the conveyor belt assembly 30. A first drive motor 42 is operably coupled to the pulley assembly 41. Such a first drive motor 42 includes a drive shaft 43 directly mated, without the use of intervening elements, to the pulley assembly 41 and is selectively operable during operating conditions. A platform 44 is directly connected, without the use of intervening elements, to the pulley assembly 41 and maintains a static relationship therewith, which is essential such that the platform 44 effectively moves vertically and in sync with the pulley assembly 41. A second drive motor 35 includes a drive shaft 36 directly coupled, without the use of intervening elements, to the conveyor belt assembly 30.

Again referring to FIGS. 1 through 6, a vacuum head 37 is operably connected directly, without the use of intervening elements, to the conveyor belt assembly 30 and intercalated between the top 33A and bottom 33B sections of the unitary belt 32. Such a vacuum head 37 maintains a static relationship therewith, which is important so that the vacuum head 37 horizontally travels in sync with the conveyor belt assembly 30. The vacuum head 37 is situated above a top napkin 12A of the napkin stack 12 and effectively transfers the top napkin 12A across the conveyor belt assembly 30 where the top napkin 12 is conveniently and effectively deposited at the unitary area before the eating utensils 11 are released from the hoppers 20. A motor 38 is in fluid communication with the vacuum head 37, which is important for conveniently and effectively extracting a predetermined volume of air away therefrom during operating conditions, wherein a suction force is created for adhering the top napkin 12A to the vacuum head 37 and allowing same to transport the top napkin 12A along the conveyor belt assembly 30.

Referring to FIGS. 1 through 5, a mechanism 50 is included for simultaneously folding the napkin 12 and horizontally registering the eating utensils 11 in a stacked relationship, which is vital such that the napkin 12 conveniently and effectively becomes folded about the eating utensils 11 before being ejected from the simultaneous folding mechanism 50. This process greatly reduces the amount of time needed for folding eating utensils 11 within a napkin 12, while also eliminating the need to employ a person to perform the task manually, which saves the user a considerably amount of time and money. Such a simultaneous folding mechanism 50 includes a central rod 51 transversely oriented to the conveyor belt assembly 30 and situated therebelow.

Figure 3:
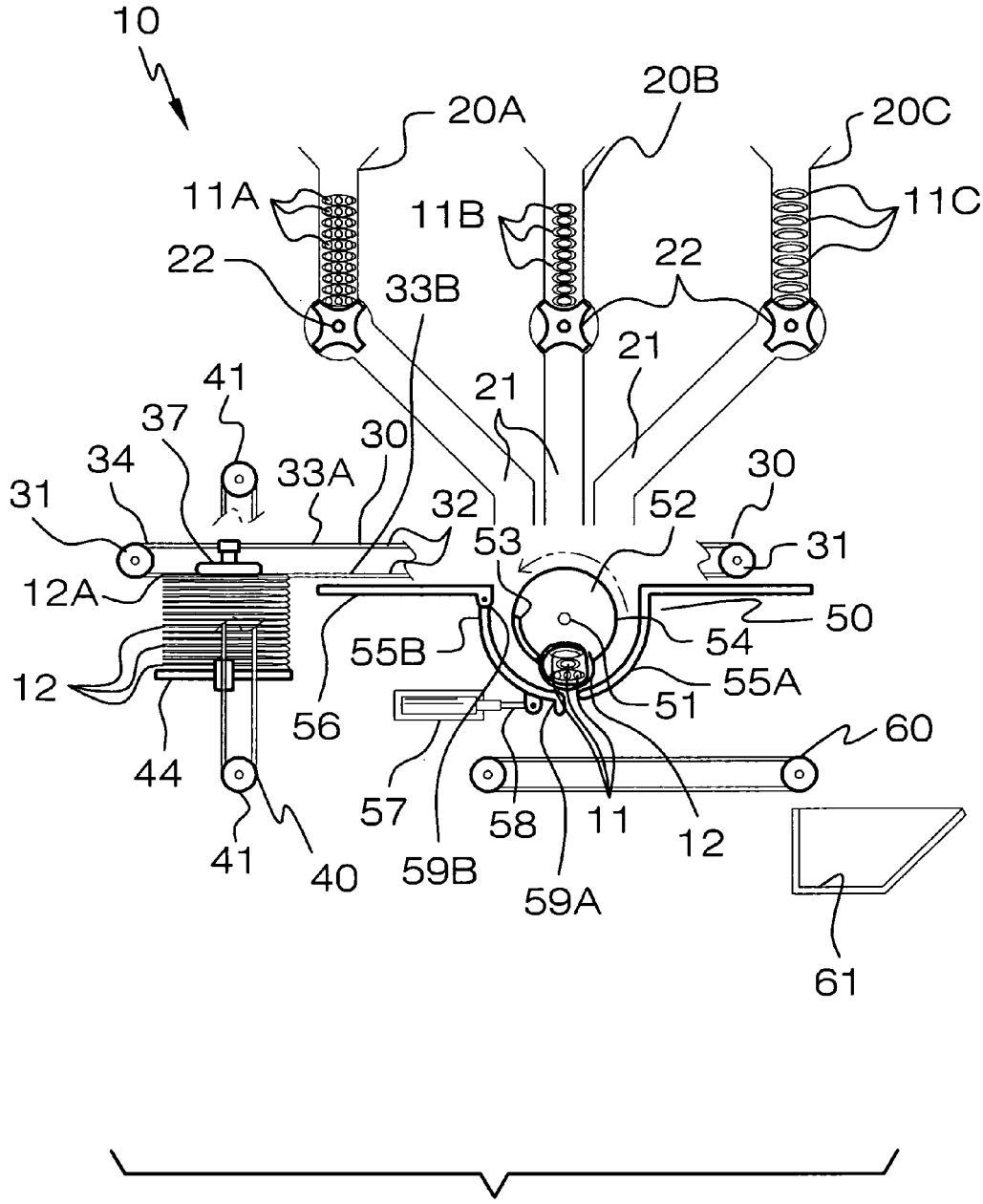
FIG. 3 is a side-elevational view of the device shown in FIG. 1, showing the device after the napkin is positioned about the eating utensils.
Figure 4:
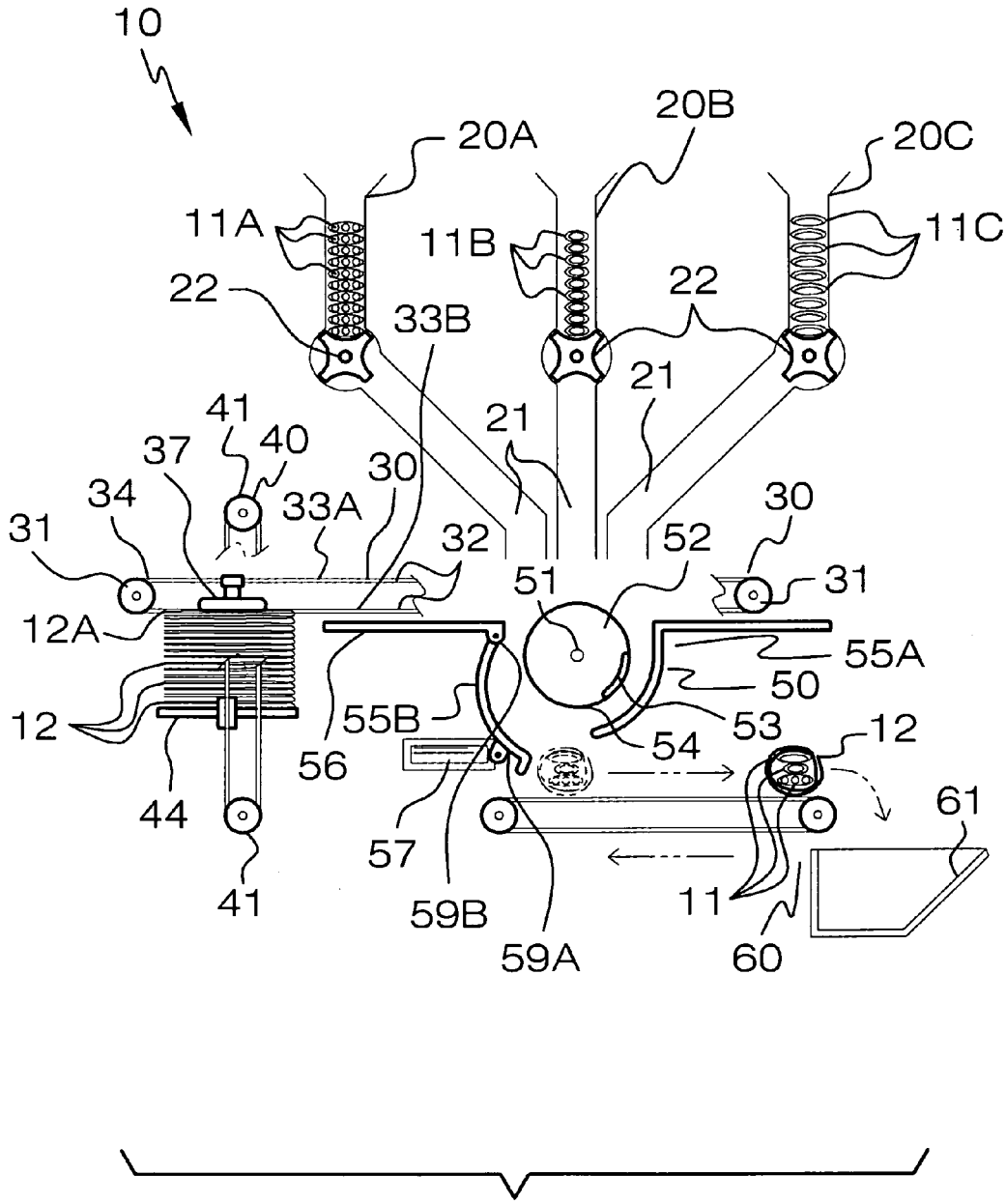
FIG. 4 is a side-elevational view of the device shown in FIG. 1, showing the eating utensils deposited onto the receiving conveyor belt after being wrapped within the napkin.
Figure 5:
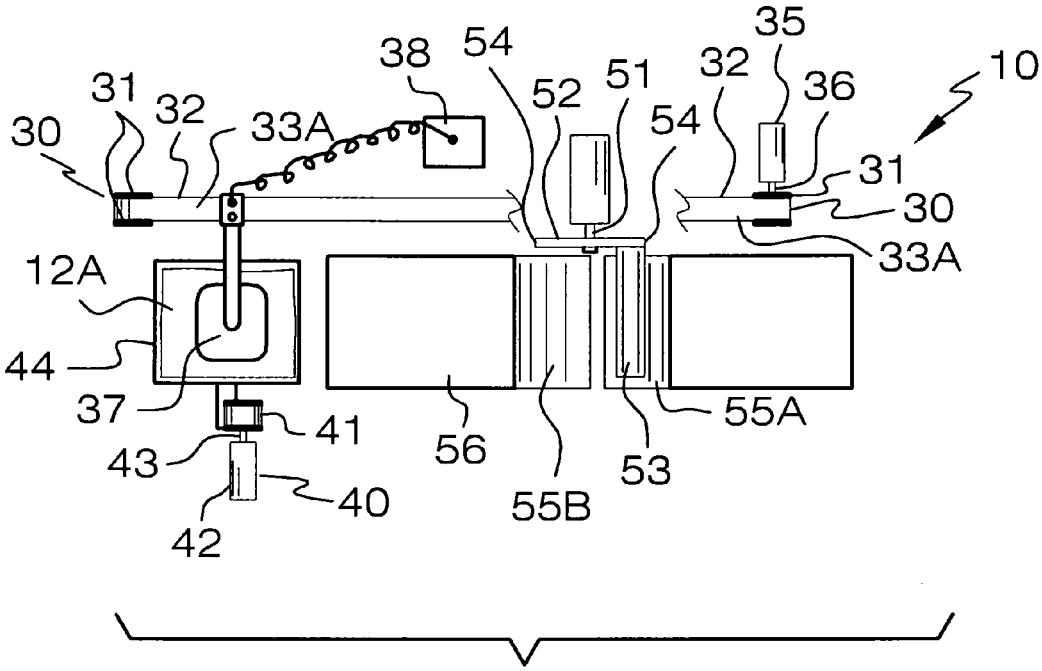
FIG. 5 is a top plan view of the device shown in FIG. 1.
Figure 6:
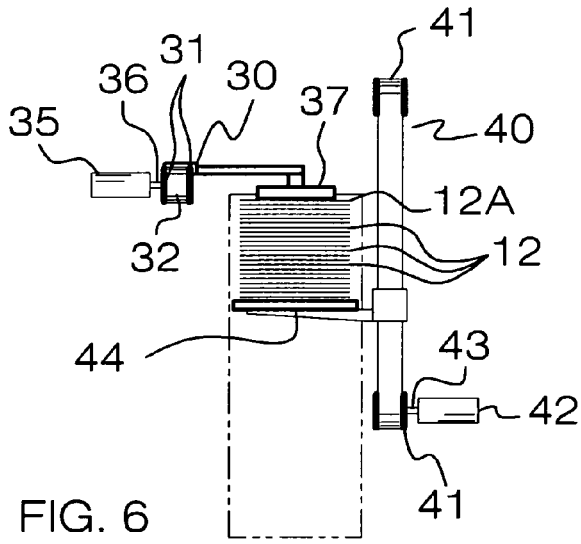
FIG. 6 is a front-elevational view of the device shown in FIG. 5, showing the vacuum head drive motor and the platform drive motor.

A cylindrical drum 52 is journaled about the rod 51 and includes an arm 53 monolithically formed with an outer edge 54 thereof. A stationary rail 55A has an arcuate shape outwardly spaced from the drum 52. A dynamic rail 55B has an arcuate shape outwardly spaced from the drum 52 and oppositely aligned with the stationary rail 55A. Such a dynamic rail 55B is pivotally connected to a support surface 56 subjacent to the conveyor belt assembly 30. A drive motor 57 includes an actuator arm 58 selectively adaptable between extended and retracted positions. Such an actuator arm 58 is directly attached, without the use of intervening elements, to a bottom edge 59A of the dynamic rail 55B and thereby causes the dynamic rail 55B to pivot about a top edge 59B thereof when the actuator arm 58 is biased between extended and retracted positions, as is best shown in FIGS. 3 and 4.

Referring to FIGS. 1 through 4, a receiving conveyor belt assembly 60 is disposed beneath the simultaneous folding mechanism 50, which is crucial for advantageously transporting the combined napkin 12 and eating utensils 11 to a remote location. A storage bin 61 is laid adjacent to the receiving conveyor belt 60 and effectively houses the combined napkin 12 and eating utensils 11 for transit.

Figure 7:
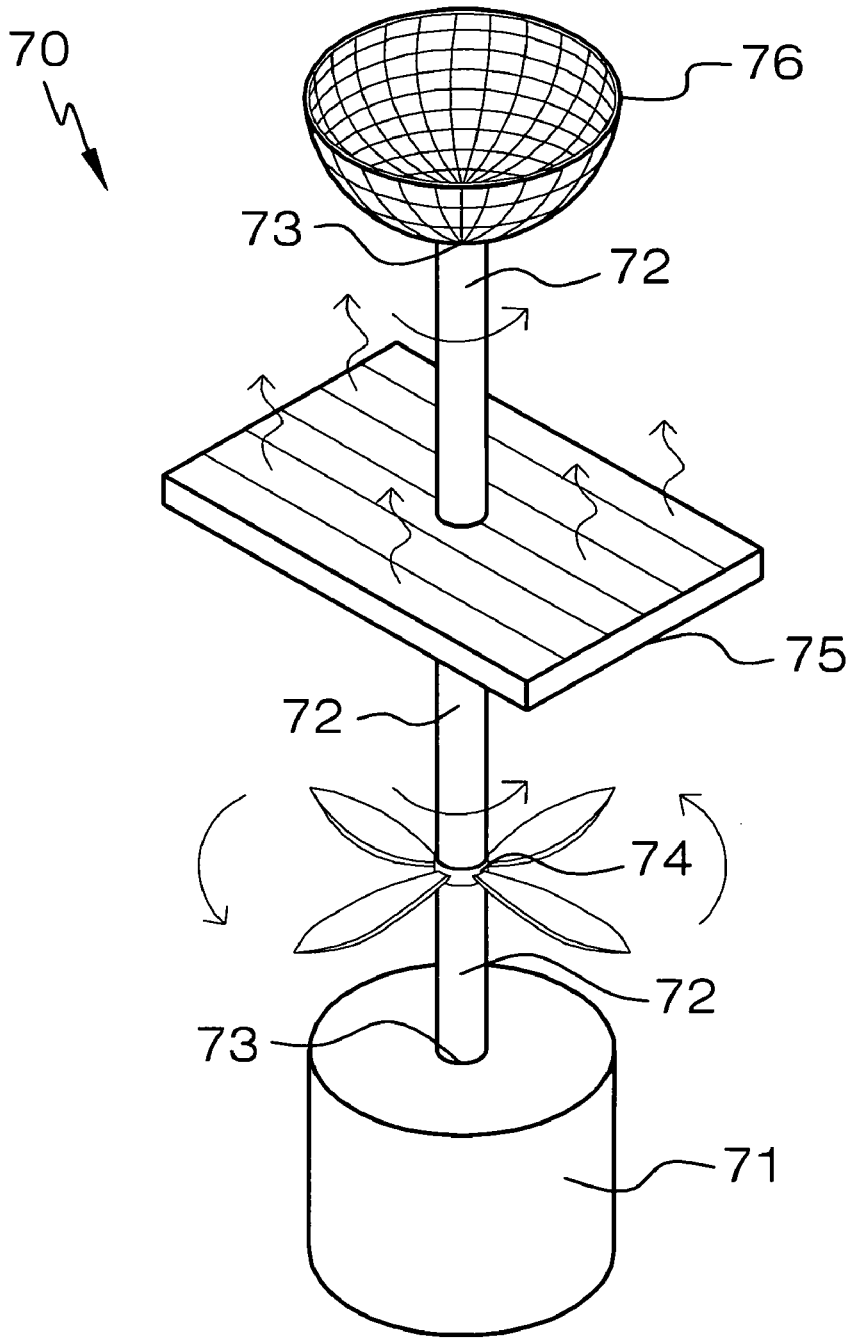
FIG. 7 is a perspective view showing the utensil drying assembly, in accordance with the present invention.

Referring to FIG. 7, the device 10 further includes a utensil drying assembly 70. Such a utensil drying assembly 70 includes a power operated motor 71 and a central conduit 72 that has axially opposed end portions 73 directly abutted, without the use of intervening elements, against the motor 71 and extending vertically upward therefrom. A rotary fan 74 is electrically mated to the power operated motor 71 and is vital for effectively generating an air flow upwardly about the conduit 72. A thermoelectric heating element 75 is seated upstream of the fan 74. The air flow has a first ambient temperature downstream of the heating element 75 and has a second ambient temperature after passing upwardly through the heating element 75 that is essential and advantageous for conveniently drying the eating utensils 11 prior to being discharged onto the napkin 12 during operating conditions. A drying basket 76 is directly attached, without the use of intervening elements to a top end portion 73A of the conduit 72. Such a drying basket is critical and advantageous for housing the eating utensils therein during operating conditions so that same can conveniently be dried by the heated air flow from the heating element 75.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A power operated device for automatically folding napkins and the like about eating utensils, said device comprising:

a plurality of isolated hoppers defining a plurality of independent passageways converging downwardly towards a central and unitary area for feeding a plurality of utensils;

a conveyor belt assembly horizontally disposed subjacent said hoppers and traversing said passageways, said conveyor belt assembly traveling along a linear path passing through said unitary area;

means for selectively depositing a single napkin into said unitary area during operating conditions by moving said napkin depositing means by said conveyor belt assembly and which deposit means is mounted on one portion of said conveyor belt; and means for simultaneously folding the napkin and horizontally registering the eating utensils in a stacked relationship such that the napkin becomes folded about the eating utensils before being ejected from said simultaneous folding means.

2. The device of claim 1, wherein each said hoppers comprises:

a rotatable dispenser directly connected thereto and seated approximately midway down said passageway, said dispenser being simultaneously articulated for discharging a single type of the eating utensil downwardly towards said unitary area.

3. The device of claim 1, wherein said conveyor belt assembly comprises:

a plurality of pulleys horizontally aligned and maintained at a static spatial relationship; and a unitary belt operably engaged about said pulleys wherein said unitary belt includes top and bottom sections vertically registered parallel to a horizontal plane.

4. The device of claim 3, wherein said napkin depositing means comprises:

a vertically registered pulley assembly traversing a horizontal path defined by said conveyor belt assembly;

a first drive motor operably coupled to said pulley assembly, said first drive motor including a drive shaft directly mated to said pulley assembly and being selectively operable during operating conditions;

a platform directly connected to said pulley assembly and maintaining a static relationship therewith such that said platform moves vertically and in sync with said pulley assembly;

a second drive motor including a drive shaft directly coupled to said conveyor belt assembly;

a vacuum head operably connected directly to said conveyor belt assembly and intercalated between said top and bottom sections of said unitary belt, said vacuum head maintaining a static relationship therewith such that said vacuum head horizontally travels in sync with said conveyor belt assembly, said vacuum head being situated above a top one of the napkin stack and transferring the top napkin across said conveyor belt assembly where the top napkin is deposited at said unitary area before the eating utensils are released from said hoppers; and a motor in fluid communication with said vacuum head for extracting a predetermined volume of air away therefrom during operating conditions.

5. The device of claim 1, wherein said simultaneous folding means comprises:

a central rod transversely oriented to said conveyor belt assembly and situated therebelow;

a cylindrical drum journaled about said rod and including an arm monolithically formed with an outer edge thereof;

a stationary rail having an arcuate shape outwardly spaced from said drum;

a dynamic rail having an arcuate shape outwardly spaced from said drum and oppositely aligned with said stationary rail, said dynamic rail being pivotally connected to a support surface subjacent said conveyor belt assembly; and a drive motor including an actuator arm selectively adaptable between extended and retracted positions, said actuator arm being directly attached to a bottom edge of said dynamic rails and thereby causing said dynamic rail to pivot about a top edge thereof when said actuator arm is biased between the extended and retracted positions.

6. The device of claim 1, further comprising:

a power operated motor;

a central conduit having axially opposed end portions directly abutted against said motor and extending vertically upward therefrom;

a rotary fan electrically mated to said power operated motor and generating an air flow upwardly about said conduit; and a thermoelectric heating element seated upstream of said fan, wherein the air flow has a first ambient temperature downstream of said heating element and has a second ambient temperature after passing upwardly through said heating element for drying the eating utensils prior to being discharged onto the napkin during operating conditions.

7. A power operated device for automatically folding napkins and the like about eating utensils, said device comprising:

a plurality of isolated hoppers defining a plurality of independent passageways converging downwardly towards a central and unitary area for feeding a plurality of utensils;

a conveyor belt assembly horizontally disposed subjacent said hoppers and traversing said passageways, said conveyor belt assembly traveling along a linear path passing through said unitary area;

means for selectively depositing a single napkin into said unitary area during operating conditions by moving said napkin depositing means by said conveyor belt assembly and which deposit means is mounted on one portion of said conveyor belt;

means for simultaneously folding the napkin and horizontally registering the eating utensils in a stacked relationship such that the napkin becomes folded about the eating utensils before being ejected from said simultaneous folding means; and a receiving conveyor belt assembly disposed beneath said simultaneous folding means for transporting the combined napkin and eating utensils to a remote location.

8. The device of claim 7, wherein each said hoppers comprises:

a rotatable dispenser directly connected thereto and seated approximately midway down said passageway, said dispenser being simultaneously articulated for discharging a single type of the eating utensil downwardly towards said unitary area.

9. The device of claim 7, wherein said conveyor belt assembly comprises:

a plurality of pulleys horizontally aligned and maintained at a static spatial relationship; and a unitary belt operably engaged about said pulleys wherein said unitary belt includes top and bottom sections vertically registered parallel to a horizontal plane.

10. The device of claim 9, wherein said napkin depositing means comprises:

a vertically registered pulley assembly traversing a horizontal path defined by said conveyor belt assembly;

a first drive motor operably coupled to said pulley assembly, said first drive motor including a drive shaft directly mated to said pulley assembly and being selectively operable during operating conditions;

a platform directly connected to said pulley assembly and maintaining a static relationship therewith such that said platform moves vertically and in sync with said pulley assembly;

a second drive motor including a drive shaft directly coupled to said conveyor belt assembly;

a vacuum head operably connected directly to said conveyor belt assembly and intercalated between said top and bottom sections of said unitary belt, said vacuum head maintaining a static relationship therewith such that said vacuum head horizontally travels in sync with said conveyor belt assembly, said vacuum head being situated above a top one of the napkin stack and transferring the top napkin across said conveyor belt assembly where the top napkin is deposited at said unitary area before the eating utensils are released from said hoppers; and a motor in fluid communication with said vacuum head for extracting a predetermined volume of air away therefrom during operating conditions.

11. The device of claim 7, wherein said simultaneous folding means comprises:

a central rod transversely oriented to said conveyor belt assembly and situated therebelow;

a cylindrical drum journaled about said rod and including an arm monolithically formed with an outer edge thereof;

a stationary rail having an arcuate shape outwardly spaced from said drum;

a dynamic rail having an arcuate shape outwardly spaced from said drum and oppositely aligned with said stationary rail, said dynamic rail being pivotally connected to a support surface subjacent said conveyor belt assembly; and a drive motor including an actuator arm selectively adaptable between extended and retracted positions, said actuator arm being directly attached to a bottom edge of said dynamic rails and thereby causing said dynamic rail to pivot about a top edge thereof when said actuator arm is biased between the extended and retracted positions.

12. The device of claim 7, further comprising:

a power operated motor;

a central conduit having axially opposed end portions directly abutted against said motor and extending vertically upward therefrom;

a rotary fan electrically mated to said power operated motor and generating an air flow upwardly about said conduit; and a thermoelectric heating element seated upstream of said fan, wherein the air flow has a first ambient temperature downstream of said heating element and has a second ambient temperature after passing upwardly through said heating element for drying the eating utensils prior to being discharged onto the napkin during operating conditions.

13. A power operated device for automatically folding napkins and the like about eating utensils, said device comprising:

a plurality of isolated hoppers defining a plurality of independent passageways converging downwardly towards a central and unitary area for feeding a plurality of utensils;

a conveyor belt assembly horizontally disposed subjacent said hoppers and traversing said passageways, said conveyor belt assembly traveling along a linear path passing through said unitary area;

means for selectively depositing a single napkin into said unitary area during operating conditions by moving said napkin depositing means by said conveyor belt assembly and which deposit means is mounted on one portion of said conveyor belt;

means for simultaneously folding the napkin and horizontally registering the eating utensils in a stacked relationship such that the napkin becomes folded about the eating utensils before being ejected from said simultaneous folding means;

a receiving conveyor belt assembly disposed beneath said simultaneous folding means for transporting the combined napkin and eating utensils to a remote location; and a storage bin laid adjacent to said receiving conveyor belt and housing the combined napkin and eating utensils for transit.

14. The device of claim 13, wherein each said hoppers comprises:

a rotatable dispenser directly connected thereto and seated approximately midway down said passageway, said dispenser being simultaneously articulated for discharging a single type of the eating utensil downwardly towards said unitary area.

15. The device of claim 13, wherein said conveyor belt assembly comprises:

a plurality of pulleys horizontally aligned and maintained at a static spatial relationship; and a unitary belt operably engaged about said pulleys wherein said unitary belt includes top and bottom sections vertically registered parallel to a horizontal plane.

16. The device of claim 15, wherein said napkin depositing means comprises:

a vertically registered pulley assembly traversing a horizontal path defined by said conveyor belt assembly;

a first drive motor operably coupled to said pulley assembly, said first drive motor including a drive shaft directly mated to said pulley assembly and being selectively operable during operating conditions;

a platform directly connected to said pulley assembly and maintaining a static relationship therewith such that said platform moves vertically and in sync with said pulley assembly;

a second drive motor including a drive shaft directly coupled to said conveyor belt assembly;

a vacuum head operably connected directly to said conveyor belt assembly and intercalated between said top and bottom sections of said unitary belt, said vacuum head maintaining a static relationship therewith such that said vacuum head horizontally travels in sync with said conveyor belt assembly, said vacuum head being situated above a top one of the napkin stack and transferring the top napkin across said conveyor belt assembly where the top napkin is deposited at said unitary area before the eating utensils are released from said hoppers; and a motor in fluid communication with said vacuum head for extracting a predetermined volume of air away therefrom during operating conditions.

17. The device of claim 13, wherein said simultaneous folding means comprises:

a central rod transversely oriented to said conveyor belt assembly and situated therebelow;

a cylindrical drum journaled about said rod and including an arm monolithically formed with an outer edge thereof;

a stationary rail having an arcuate shape outwardly spaced from said drum;

a dynamic rail having an arcuate shape outwardly spaced from said drum and oppositely aligned with said stationary rail, said dynamic rail being pivotally connected to a support surface subjacent said conveyor belt assembly; and a drive motor including an actuator arm selectively adaptable between extended and retracted positions, said actuator arm being directly attached to a bottom edge of said dynamic rails and thereby causing said dynamic rail to pivot about a top edge thereof when said actuator arm is biased between the extended and retracted positions.

18. The device of claim 13, further comprising:

a power operated motor;

a central conduit having axially opposed end portions directly abutted against said motor and extending vertically upward therefrom;

a rotary fan electrically mated to said power operated motor and generating an air flow upwardly about said conduit; and a thermoelectric heating element seated upstream of said fan, wherein the air flow has a first ambient temperature downstream of said heating element and has a second ambient temperature after passing upwardly through said heating element for drying the eating utensils prior to being discharged onto the napkin during operating conditions.

* * * * *